US008378921B2

(12) United States Patent
Delfeld et al.

(10) Patent No.: US 8,378,921 B2
(45) Date of Patent: Feb. 19, 2013

(54) BROADBAND MULTI-TAP ANTENNA

(75) Inventors: Thomas Peter Delfeld, Newcastle, WA (US); Matthew Gregory Rivett, Seattle, WA (US)

(73) Assignee: The Boeing Company, Chicago, IL (US)

( * ) Notice: Subject to any disclaimer, the term of this patent is extended or adjusted under 35 U.S.C. 154(b) by 1210 days.

(21) Appl. No.: 12/200,259

(22) Filed: Aug. 28, 2008

(65) Prior Publication Data

US 2012/0249389 A1 Oct. 4, 2012

(51) Int. Cl.
*H01Q 1/00* (2006.01)
*H01Q 21/00* (2006.01)

(52) U.S. Cl. ..... 343/905; 343/893

(58) Field of Classification Search ..... 343/705, 343/708, 749, 751, 825, 826, 827, 829, 830, 343/831, 844, 893, 905
See application file for complete search history.

(56) References Cited

U.S. PATENT DOCUMENTS

| | | | | |
|---|---|---|---|---|
| 4,509,053 | A | 4/1985 | Robin et al. | |
| 4,630,064 | A | 12/1986 | Andrews et al. | |
| 5,070,340 | A | 12/1991 | Diaz | |
| 5,392,053 | A * | 2/1995 | Hirata et al. | 343/700 MS |
| 5,771,022 | A * | 6/1998 | Vaughan et al. | 343/702 |
| 7,003,058 | B2 | 2/2006 | Bach et al. | |

* cited by examiner

*Primary Examiner* — Robert Karacsony
(74) *Attorney, Agent, or Firm* — Yee & Associates, P.C.

(57) ABSTRACT

An antenna system comprises a plurality of conductors, a combiner, and a plurality of loads. The combiner has an output port. The plurality of loads connects the plurality of conductors to each other in line. The plurality of loads has an impedance equal to a desired impedance for the output port. The combiner combines power received by the plurality of loads at the output port of the combiner.

9 Claims, 9 Drawing Sheets

300

306
308
307
1"
8"
50 OHM
302
304
5.0
0.0
-5.0
-10.0
-15.0
-20.0
-25.0
0.0
0.5
1.0
1.5
2.0
2.5
3.0
3.5
4.0
FREQUENCY (GHz)
GAIN INTO 50 OHM LOAD AT HORIZON (dBi)

BROADBAND MULTI-TAP ANTENNA

BACKGROUND INFORMATION

1. Field

The present disclosure relates generally to antennas and in particular to a method and apparatus for transmitting and/or receiving radio frequency energy at different frequencies.

2. Background

Any passive antenna acts identically when used as either a transmitter or a receiver. For the purpose of clarity, most of the following descriptions are related to operation as a receiver.

As a receiver, an antenna converts electromagnetic waves into an electrical current, and as a transmitter, converts an electrical current into electromagnetic waves. An antenna is a structure that may generate an electromagnetic field in response to an alternating voltage and an associated electric current being applied to an antenna when it is functioning as a transmitter. This structure also may generate an alternating current and voltage between the terminals of the antenna when exposed to an electromagnetic field when functioning as a receiver.

Antennas are used in many different systems and applications, such as, for example, communications, wireless local networks, radar, and other systems and applications. For example, antennas may be used on aircraft to provide communications and other functions for the aircraft. In many cases, physical space on an aircraft is limited. Therefore, it is desirable to have an antenna that is as small as possible.

The transmit antenna or the receive antenna may be out of the control of the antenna designer. This situation leads to constraints on the particular antenna being designed. The required gain of an antenna is set by signal-to-noise ratios of the entire radio frequency system, which includes both transmit antennas and receive antennas.

As an example, the designer of an FM radio has no control over the transmitters located at the radio stations. The designer must design a receive antenna for the FM radio that can receive signals over the entire FM radio band with adequate strength. The amount of antenna gain is related to the efficiency and radiation pattern of an antenna. Antenna size is defined here in terms of wavelengths. A small antenna is defined as one that is a fraction of wavelength in size. For small antennas, the radiation pattern is fixed and the gain is related directly to the efficiency.

On an aircraft, the antenna is designed to meet physical space (which is directly related to size) and performance requirements. One way to make an antenna small is to sacrifice bandwidth. With a broadband antenna, a single antenna may be used in place of multiple antennas that operate at different frequencies. Bandwidth restrictions are set by required data rates needed for transmission by the radio frequency system.

An antenna that is small, however, may have significant dissipative (conductive) loss, which reduces the gain. This dissipative loss allows the smaller antenna to operate in a broadband manner, but reduces the efficiency. In fact, losses in gain may be incorporated on purpose to increase the bandwidth of an antenna at the expense of efficiency. Thus, for any antenna type, small antennas are either narrowband or broadband with reduced efficiency.

Therefore, it would be advantageous to have a method and apparatus to overcome the problems described above.

SUMMARY

In one advantageous embodiment, an antenna system comprises a plurality of conductors, a combiner, and a plurality of loads. The combiner has an output port. The plurality of loads connects the plurality of conductors to each other in line. The plurality of loads has an impedance equal to a desired impedance for the output port. The combiner combines power received by the plurality of loads at the output port of the combiner.

In another advantageous embodiment, an antenna system comprises a plurality of conductors, a plurality of dual conductor transmission lines, and a combiner. The plurality of conductors is capable of receiving radio frequency signals. A terminal is present at a first end of each dual conductor transmission line to form a plurality of terminals. A first conductive connector at the terminal is connected to a selected conductor and a second conductive connector at the terminal is connected to the selected conductor and an adjacent conductor. The combiner has a plurality of inputs connected to a second end of the plurality of dual conductor transmission lines. The combiner is capable of combining each signal received at the plurality of inputs to form a signal at an output.

In yet another advantageous embodiment, a method is present for receiving radio frequency signals at an antenna system. A radio frequency signal is received at a plurality of conductors for the antenna system. An electrical signal is generated at each of the plurality of conductors, in which the electrical signal is generated in response to the radio frequency signal to form a plurality of electrical signals. The plurality of electrical signals is received at a plurality of terminals for a plurality of dual conductor transmission lines. A terminal is present at a first end of each dual conductor transmission line. A first conductive connector at the terminal is connected to a selected conductor and a second conductive connector at the terminal is connected to the selected conductor and an adjacent conductor. The plurality of electrical signals received at the plurality of terminals is combined into a single signal.

The features, functions, and advantages can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the advantageous embodiments are set forth in the appended claims. The advantageous embodiments, however, as well as a preferred mode of use, further objectives and advantages thereof, will best be understood by reference to the following detailed description of an advantageous embodiment of the present disclosure when read in conjunction with the accompanying drawings, wherein:

DETAILED DESCRIPTION

Compact or small antennas that meet limited physical space requirements, yet are broad band and highly efficient are described herein. These embodiments can generally be referred to broad band, multi-tap antenna. A tap is a location on a structure of an antenna from which power may be collected, dissipated, or distributed. These taps may also be described as loads. As an example, the single feed point at the base of a monopole antenna forms a single tap, meaning that radio frequency power can be delivered to a load at that location. The multi-tap antennas described herein are typically about 1/10th wavelength long at the lowest frequency of operation (longest wavelength).

With multiple taps, it is possible to collect or divert power from various locations on the antenna structure into a single radio frequency load or port. The use of multiple taps has significant advantages for the reduction of antenna size and bandwidth without the constraints imposed by prior methods. The details of apparatus' and methods of making these antennas for advantageous embodiments are described in detail below.

This description is not meant to limit use to the aerospace industry. For example, the exemplary embodiments may be used on ground vehicles, ships, cell phones, wireless internet access, and radios. Turning again to the exemplary embodiment in the aerospace industry, it is helpful to provide some background information about the environment, in which some advantageous embodiments may be so implemented.

Figure 1:
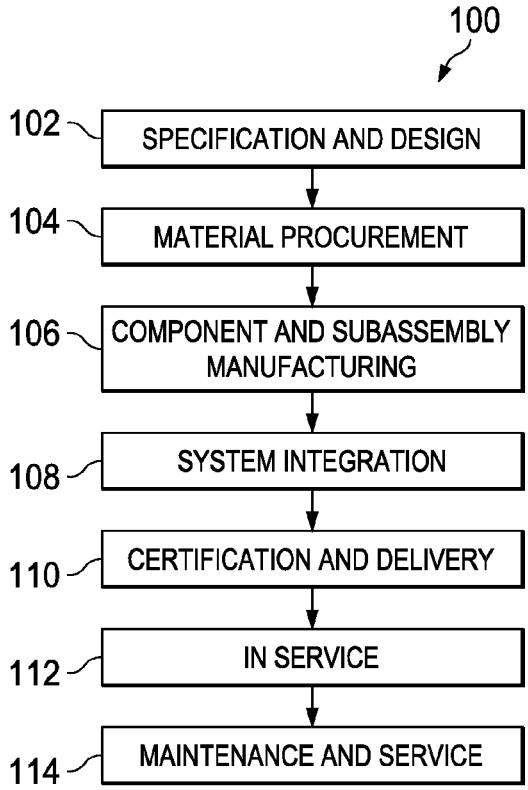
FIG. 1 is a diagram illustrating an aircraft manufacturing and service method in accordance with an advantageous embodiment.
Figure 2:
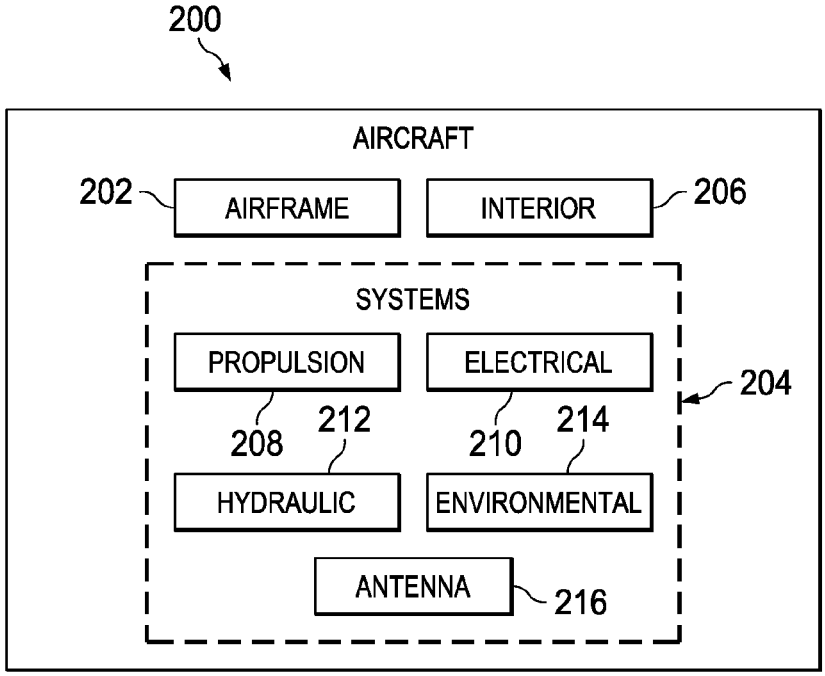
FIG. 2 is a diagram of an aircraft in which an advantageous embodiment may be implemented.

Referring more particularly to the drawings, embodiments of the disclosure may be described in the context of the aircraft manufacturing and service method 100 as shown in FIG. 1 and aircraft 200 as shown in FIG. 2. Turning first to FIG. 1, a diagram illustrating an aircraft manufacturing and service method is depicted in accordance with an advantageous embodiment. During pre-production, exemplary aircraft manufacturing and service method 100 may include specification and design 102 of aircraft 200 in FIG. 2 and material procurement 104.

During production, component and subassembly manufacturing 106 and system integration 108 of aircraft 200 in FIG. 2 takes place. Thereafter, aircraft 200 in FIG. 2 may go through certification and delivery 110 in order to be placed in service 112. While in service by a customer, aircraft 200 in FIG. 2 is scheduled for routine maintenance and service 114, which may include modification, reconfiguration, refurbishment, and other maintenance or service.

Each of the processes of aircraft manufacturing and service method 100 may be performed or carried out by a system integrator, a third party, and/or an operator. In these examples, the operator may be a customer. For the purposes of this description, a system integrator may include, without limitation, any number of aircraft manufacturers and major-system subcontractors; a third party may include, without limitation, any number of venders, subcontractors, and suppliers; and an operator may be an airline, leasing company, military entity, service organization, and so on.

With reference now to FIG. 2, a diagram of an aircraft is depicted in which an advantageous embodiment may be implemented. In this example, aircraft 200 is produced by aircraft manufacturing and service method 100 in FIG. 1 and may include airframe 202 with a plurality of systems 204 and interior 206. Examples of systems 204 include one or more of propulsion system 208, electrical system 210, hydraulic system 212, environmental system 214, and antenna system 216. Any number of other systems may be included. Although an aerospace example is shown, different advantageous embodiments may be applied to other industries, such as the automotive industry and the ship building industry.

Apparatus and methods embodied herein may be employed during any one or more of the stages of aircraft manufacturing and service method 100 in FIG. 1. For example, components or subassemblies produced in component and subassembly manufacturing 106 in FIG. 1 may be fabricated or manufactured in a manner similar to components or subassemblies produced while aircraft 200 is in service 112 in FIG. 1.

Also, one or more apparatus embodiments, method embodiments, or a combination thereof may be utilized during production stages, such as component and subassembly manufacturing 106 and system integration 108 in FIG. 1, for example, without limitation, by substantially expediting the assembly of or reducing the cost of aircraft 200. Similarly, one or more of apparatus embodiments, method embodiments, or a combination thereof may be utilized while aircraft 200 is in service 112 or during maintenance and service 114 in FIG. 1.

For example, an antenna constructed according to an advantageous embodiment may be designed for aircraft 200 during specification and design 102. Further, an advantageous embodiment may be used to implement an antenna during component and subassembly manufacturing 106 and system integration 108. As yet another example, an antenna according to an advantageous embodiment may be used during in service 112.

The different advantageous embodiments recognize that existing antennas have low gain or require a large size to obtain the desired bandwidths. As a result, a balance in reducing antenna size is made between choosing lower gain for a larger bandwidth. Another choice is to increase the size of the antenna to obtain the desired gain.

With currently used antennas, the conductor may be made out of a material that provides surface resistivity in ohms per square. With this type of resistivity, increased bandwidth may be obtained, but with losses in gain.

Figure 3:
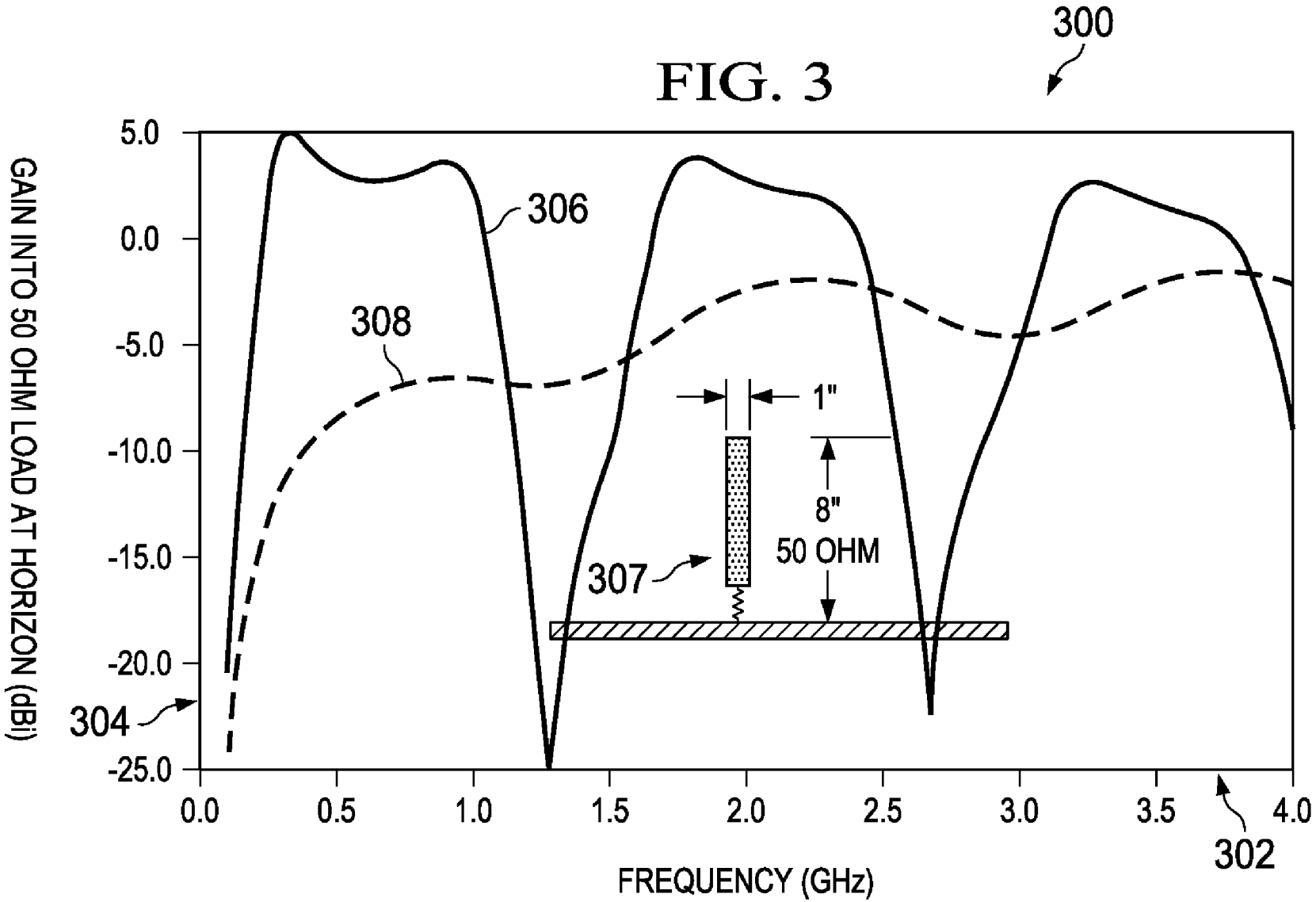
FIG. 3 is a diagram illustrating antenna gain in currently used antennas.

Turning next to FIG. 3, a diagram illustrating antenna gain in currently used antennas is depicted. In graph 300, frequency is shown on X axis 302, while gain is shown on Y axis 304. Line 306 illustrates the gain for an antenna 307 without any losses. Line 308 illustrates the gain for antenna 307 when antenna 307 is comprised of resistive materials. In this example, the resistive materials may have a resistivity of 100 ohms per square. As can be seen, the bandwidth in line 308 is increased as compared to line 306. The gain, however, is not as great as an antenna with a lower bandwidth.

The bandwidth and operating frequency of the antenna are related to the size of the antenna. As shown above, one manner in which the bandwidth may be increased is to add loss.

This loss destroys the resonant characteristics of the antenna, lowering the efficiency or gain of the antenna. This effect permits the antenna to be used over a broad range without increasing the size of the antenna.

As a result, the different advantageous embodiments provide an antenna that operates identically to one made of a resistive material, but without using materials that generate loss within the antenna itself. Instead, the different advantageous embodiments provide an antenna design that operates identically to an antenna made of a resistive material.

The different advantageous embodiments provide an apparatus having a plurality of conductors, a plurality of loads (taps), an output port, and a combiner. These loads connect the conductors to each other in line. The term loads is used to represent either true dissipative loss of energy, such as heat and loss of efficiency, or energy delivered to the radio frequency electronics. These loads tap off radio frequency power from the structure and are also called taps, hence the name multi-tap antenna. Being connected in line means that the conductors are connected to each other by the loads.

The loads each have an impedance that is equal to a desired impedance for an output port of the antenna. The spacing between these taps is on the order of 1/100th of a wavelength at the lowest frequency of the antenna's operation, in these illustrative examples. The combiner combines the power received by the loads at the output port. In this manner, power received by the loads is captured and used in a manner that provides improved gain for the apparatus.

The use of loads with the conductors broadens the bandwidth of the antenna. The power received by these loads (taps) is recovered by the combiner to decrease the impact of reduced efficiency in the antenna. The different advantageous embodiments tap or receive energy from signals generated by the conductors when exposed to an electromagnetic field, such as a radio frequency signal. This energy is sent through the loads and combined for the signal detected by the conductors.

Figure 4:
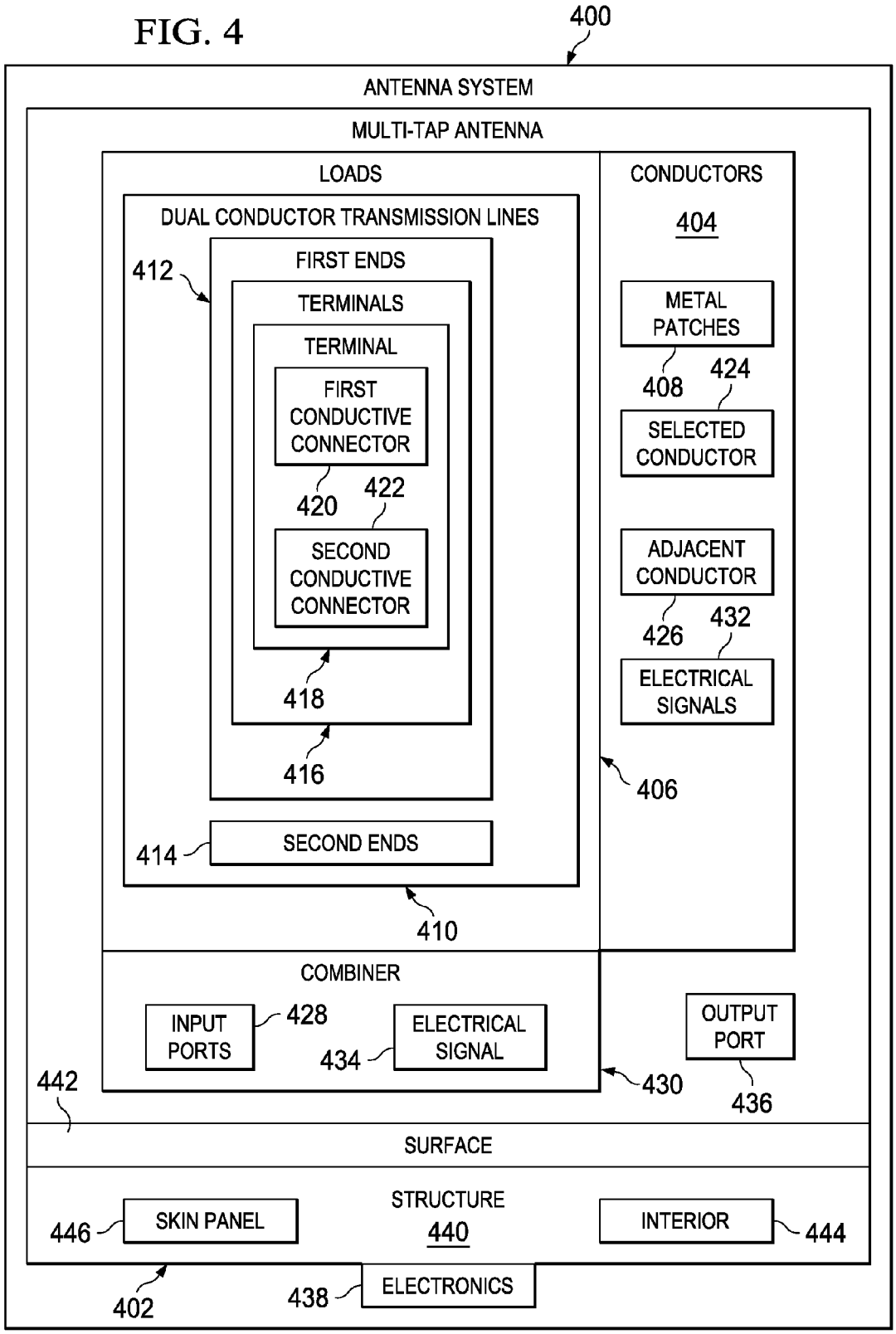
FIG. 4 is a block diagram of an antenna system in accordance with an advantageous embodiment.

With reference now to FIG. 4, a block diagram of an antenna system is depicted in accordance with an advantageous embodiment. Antenna system 400 includes multi-tap antenna 402. In this example, multi-tap antenna 402 includes conductors 404 and resistive loads 406. Conductors 404 may be any type of conductive material. In these examples, conductors 404 may be implemented using metal patches 408. Conductors 404 may functions as transducers to send and receive signals.

Loads 406 connect conductors 404 to each other in a serial arrangement. Loads 406 take the place of resistive materials currently used within an antenna to increase the bandwidth at which an antenna can function. Loads 406 perform the same function in providing loss to increase gain in multi-tap antenna 402 in these illustrative examples.

Loads 406, in this example, take the form of dual conductor transmission lines 410. These transmission lines may take various forms. For example, without limitation, dual conductor transmission lines 410 may be balanced transmission lines and/or unbalanced transmission lines. Balanced transmission lines may be coaxial cables, while unbalanced transmission lines may be ribbon cables.

Dual conductor transmission lines 410 have first ends 412 and second ends 414. First ends 412 are connected to conductors 404. The connection in first ends 412 is made using terminals 416.

For example, terminal 418 in terminals 416 has first conductive connector 420 and second conductive connector 422. First conductive connector 420 is connected to selected conductor 424 and adjacent conductor 426. Second conductive connector 422 is connected only to selected conductor 424. This type of connection is made with each dual conductive transmission line within dual conductive transmission lines 410. This type of connection architecture provides an inline connection for conductors 404. An inline connection for conductors 404 means that each conductor is connected to another conductor in conductors 404 to form an array. In these examples, first conductive conductor is used to form the inline connection.

Second ends 414 are connected to input ports 428 in combiner 430, which is also part of multi-tap antenna 402. Combiner 430 combines the electrical signals 432 generated by conductors 404 and sent through dual conductor transmission lines 410 to input ports 428 into electrical signal 434. In these examples, combiner 430 combines voltages and currents within electrical signals 432 into a single voltage and current for electrical signal 434 at output port 436. In these advantageous embodiments, combiner 430 is not frequency selective.

Output port 436 may be connected to electronics 438, such that electrical signal 434 may be processed by electronics 438. Output port 436 takes the form of a radio frequency port, which may be connected to electronics 438. Electronics 438 may be any electrical device or system for processing radio frequency signals generated at output port 436. For example, electronics 438 may be a receiver.

Input ports 428, output port 436, and dual conductor transmission lines 410 all have the same impedance in these examples. The impedance of dual conductor transmission lines 410 is set to be equal to the impedance of electronics 438, such that the transmission line looks like a resistor at the antenna. Antenna system 400 is designed to resonate at a desired frequency of operation to maximize the power delivered to the load at that frequency.

Loads 406 are designed such that the impedances for dual conductor transmission lines 410 each have a value that is equal to the impedance of output port 436.

As a result, no losses occur with loads 406. Instead, loads 406 receive and send power to combiner 430, which recombines the power at output port 436. In this manner, the bandwidth may be improved with a reduction in the loss of gain for multi-tap antenna 402 in accordance with the advantageous embodiments.

In these examples, multi-tap antenna 402 may be attached to structure 440. This attachment of multi-tap antenna 402 to structure 440 may take various forms. For example, multi-tap antenna 402 may be entirely mounted on surface 442 of structure 440. In other advantageous embodiments, some or all of the components of multi-tap antenna 402 may be mounted on surface 442 and/or within interior 444 of structure 440. In these examples, structure 440 may be aircraft 200 or a portion of aircraft 200 in FIG. 2. For example, structure 440 may be skin panel 446.

Multi-tap antenna 402, in these examples, may provide a broadband antenna that is smaller than currently existing antennas but with the same or improved performance. In these examples, a broadband antenna may be an antenna that detects around 20 percent or more of a middle frequency of operation. Of course, multi-tap antenna 402 may be applied to other frequencies in addition to or in place of broadband frequencies.

Through the use of conductors 404, power for individual loads in loads 406 may be recollected by combiner 430. This type of collection of power is in contrast to a normal dissipation or loss of power that occurs with a single antenna having an equivalent impedance of multi-tap antenna 402.

The power for each conductor in conductors 404 is recombined by combiner 430 in a manner that recovers power that is normally lost with conventional antenna designs. As a result, a larger gain is possible when using multi-tap antennas 402, as compared to currently available antennas having a similar impedance. In other words, the architecture of multi-tap antenna 402 reduces and/or eliminates the constraints on size present with currently available antennas.

Thus, multi-tap antenna 402 has improved bandwidth as compared to currently available antennas. This type of antenna also may have an improved low-end gain as well as moderate efficiency when compared to currently used antennas in which resistive materials are used in the conductors.

In this manner, the different advantageous embodiments control the losses applied to an antenna using resistance values equal to that of the impedance of the electronics in a periodic manner as described above. Further, these losses are recovered by channeling them back to the electronics with a combiner.

The illustration of antenna system 400 in FIG. 4 is not meant to imply physical or architectural limitations to the manner in which different advantageous embodiments may be implemented. For example, antenna system 400 may be implemented using various dimensions. Typical dimensions are on the order of $1/10^{th}$ the wavelength at the lowest frequency of the radio frequency band of operation (1 foot at 100 MHz) with loads (taps) spaced about 1/100th of a wavelength apart.

In different advantageous embodiments, antenna system 400 may include components in addition to or in place of the ones depicted in FIG. 4. For example, antenna system 400 may include two or more multi-tap antennas rather than just multi-tap antenna 402.

The different advantageous embodiments provide loads in a manner that provides the same broadband characteristics as currently used antennas such as antenna 307 in FIG. 3 in which resistive materials are used. With the different advantageous embodiments, power that is currently lost in the resistive materials of the currently used antennas is now dissipated in the loads.

Figure 5:
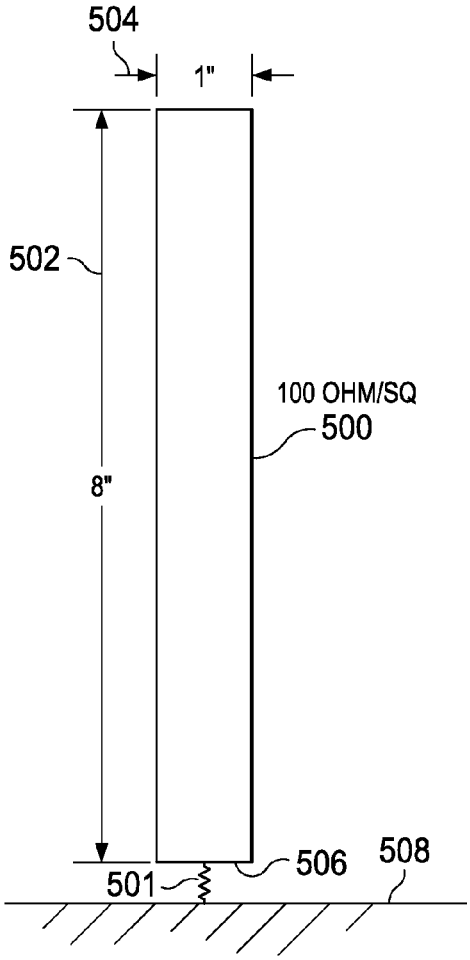
FIG. 5 is a diagram of a monopole antenna with loss in accordance with an advantageous embodiment.
Figure 6:
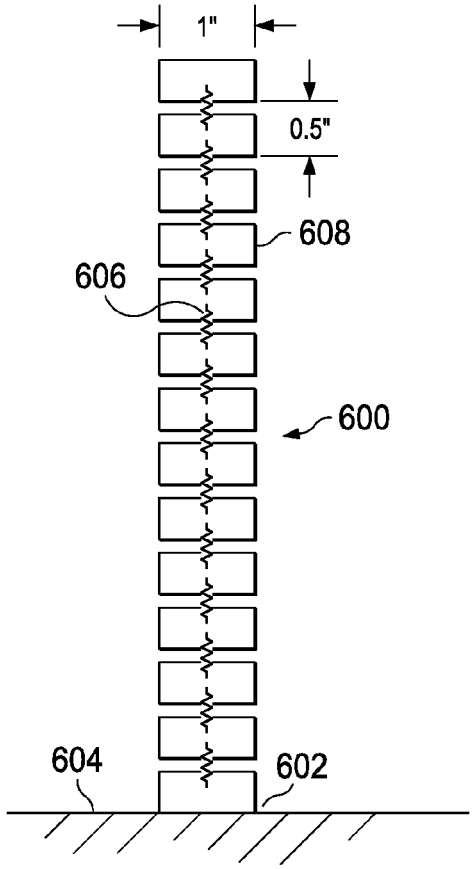
FIG. 6 is an electrical equivalent of an antenna in accordance with an advantageous embodiment.
Figure 7:
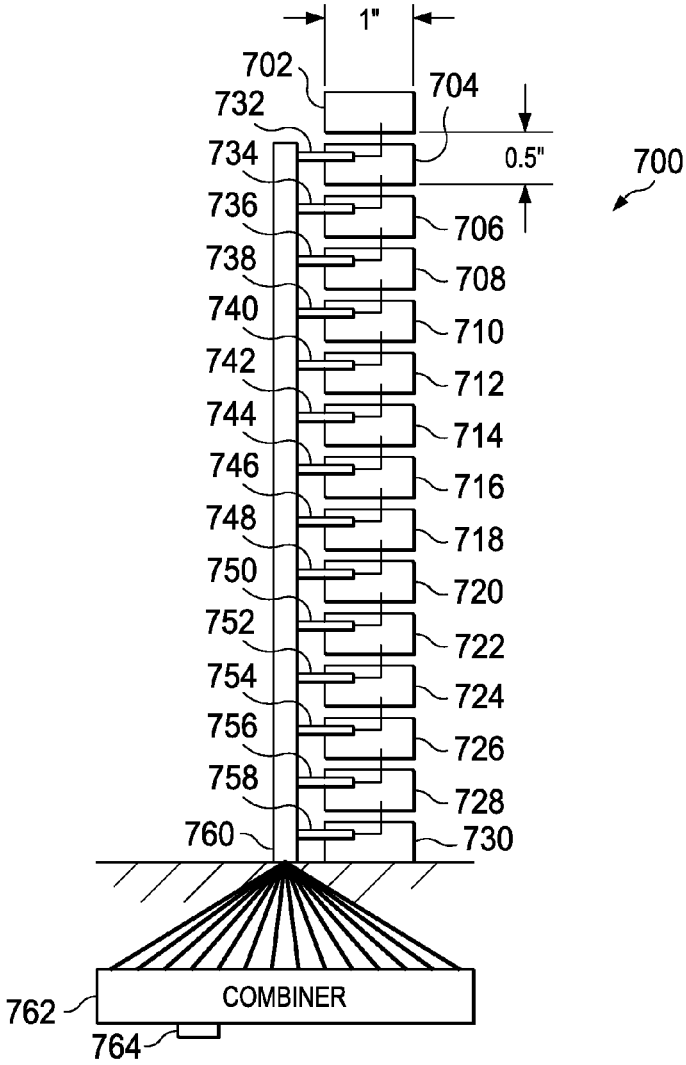
FIG. 7 is a diagram of a multi-tap antenna in accordance with an advantageous embodiment.

With reference now to FIGS. 5, 6, and 7, electrical equivalents of antennas are depicted in accordance with an advantageous embodiment. With reference first to FIG. 5, a diagram of a monopole antenna with loss is depicted in accordance with an advantageous embodiment. Monopole antenna 500 is a 100 ohm per square antenna, in this example, and fed at base 501. Monopole antenna 500 has length 502, which is around eight inches and width 504, which is around one inch. Monopole antenna 500 has end 506 attached to surface 508 where it is fed.

With reference now to FIG. 6, antenna 600 is an example of an electrical equivalent of monopole antenna 500. Antenna 600 is shown as a functional equivalent and not as a physical equivalent of multi-tap antenna 402 in FIG. 4. Antenna 600 has end 602 attached to surface 604. In this example, antenna 600 is shown in the form of a blade antenna. A blade is a form or architecture of a monopole antenna radiator.

Antenna 600 has conductors 606 and resistive loads 608. Conductors 606 and resistive loads 608 have a combined impedance of around 100 ohms per square. In this example, antenna 600 provides the same bandwidth as monopole antenna 500, but without the losses in gain. Antenna 600 is constructed by connecting material for an antenna in different sections with resistive loads having a period of $$\text{period} = \frac{R}{Rs} w$$

where Rs is the surface resistivity of the loss of the antenna, w is the width of conductors 606, and R is the resistance of each resistive load or resistor in resistive loads 608. The period defines the distance between each conductor in conductors 606. Typically, about ten resistors are used to maintain the equivalence at the highest frequency of operation.

In these illustrative embodiments, the period is selected such that the resistors each have an identical resistance to the radio frequency port. For example, with an antenna 100 ohms per square and one inch wide, the period becomes one-half inch for 50 ohm resistors. Antenna 600 operates identically to monopole antenna 500. However, the losses in gain are now confined to resistors 608 rather than within conductors 606. In this manner, improved bandwidth with reduced loss and gain may be achieved.

With reference now to FIG. 7, a diagram of a multi-tap antenna is depicted in accordance with an advantageous embodiment. In this example, multi-tap antenna 700 is an example of one implementation of multi-tap antenna 402 in FIG. 4. Multi-tap antenna 700 is in the form of a blade antenna. Multi-tap antenna 700 is an electrical equivalent of monopole antenna 500 and antenna 600 in FIG. 6.

As illustrated, multi-tap antenna 700 has conductors in the form of metal patches 702, 704, 706, 708, 710, 712, 714, 716, 718, 720, 722, 724, 726, 728, and 730. An equivalence resistance for resistive loads 608 shown for antenna 600 is provided by transmission lines 732, 734, 736, 738, 740, 742, 744, 746, 748, 750, 752, 754, 756, and 758. These transmission lines are combined or housed in collection strip 760. These transmission lines have their opposite ends connected to combiner 762.

Combiner 762 has output port 764. This output port provides an output signal for multi-tap antenna 700. The output is a 50 ohm impedance output in these examples. In these illustrative examples, each of these metal patches is around one-half inch long by around one inch wide. These metal patches in combination with the transmission lines provide a functional equivalent of the structure illustrated for antenna 600 in FIG. 6.

Figure 8:
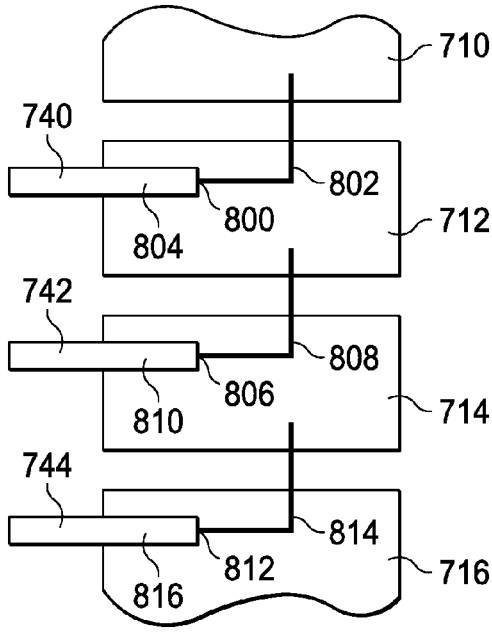
FIG. 8 is a diagram illustrating an interconnection between conductors in accordance with an advantageous embodiment.

With reference now to FIG. 8, a diagram illustrating an interconnection between conductors is depicted in accordance with an advantageous embodiment. In this example, a portion of the metal patches in multi-tap antenna 700 are depicted in more detail along with associated transmission lines.

As can be seen in this depicted example, metal patches 710, 712, 714, and 716 are connected to each other through transmission lines 740, 742 and 744. These transmission lines are dual conductor transmission lines. In other words, each transmission line has two conductors.

For example, transmission line 740 has shield 800 and conductor 802 at terminal 804. Shield 800 is electrically connected to metal patch 712, while conductor 802 is electrically connected to metal patches 710 and 712. Transmission line 742 has shield 806 and conductor 808 at terminal end 810. Shield 806 is electrically connected only to metal patch 714. Conductor 808 is electrically connected to metal patch 714 and metal patch 712. Transmission line 744 has shield 812 and conductor 814 at terminal 816. Shield 812 is electrically connected to metal patch 716, while conductor 814 is electrically connected to metal patch 716 and metal patch 714.

This configuration of connections between transmission lines and metal patches is an example of an inline configuration with multiple taps. The signals generated by each metal patch are sent through an associated transmission line, with all of the signals being recombined to form a single signal with a desired impedance for the antenna.

Figure 9:
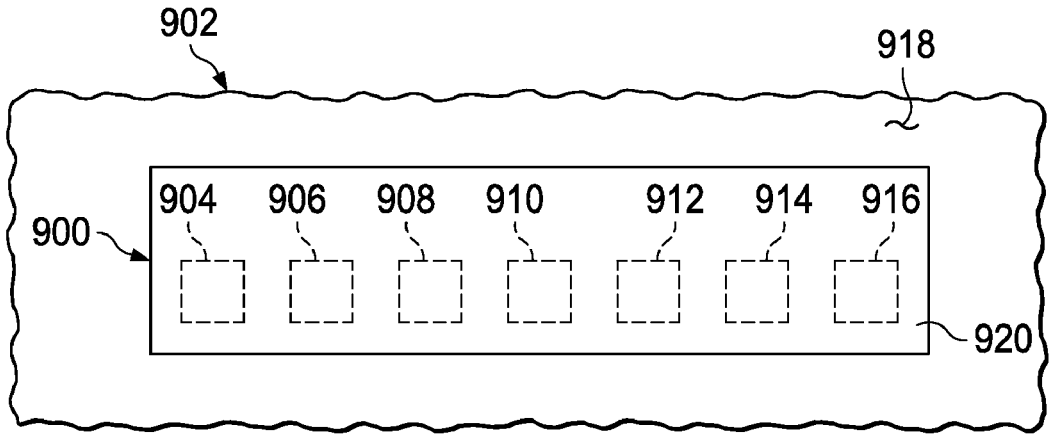
FIG. 9 is a diagram illustrating a multi-tap antenna in accordance with an advantageous embodiment.

With reference now to FIG. 9, a diagram illustrating a multi-tap antenna is depicted in accordance with an advantageous embodiment. In this example, multi-tap antenna 900 is shown as a surface mount antenna on metallic skin 902. With this type of implementation, multi-tap antenna 900 may be conformal to a surface of metallic skin 902. In other words, multi-tap antenna 900 may conform or take a shape that fits any curves and/or contours in metallic skin 902.

Metallic skin 902 may be metallic skin for a structure such as, for example, an aircraft skin panel. In this example, a top view of multi-tap antenna 900 is depicted. Multi-tap antenna 900 has metal patches 904, 906, 908, 912, 914, and 916 mounted on surface 918 of metallic skin 902. Other components for multi-tap antenna 900 may be located within cavity 920, which is located below surface 918.

Figure 10:
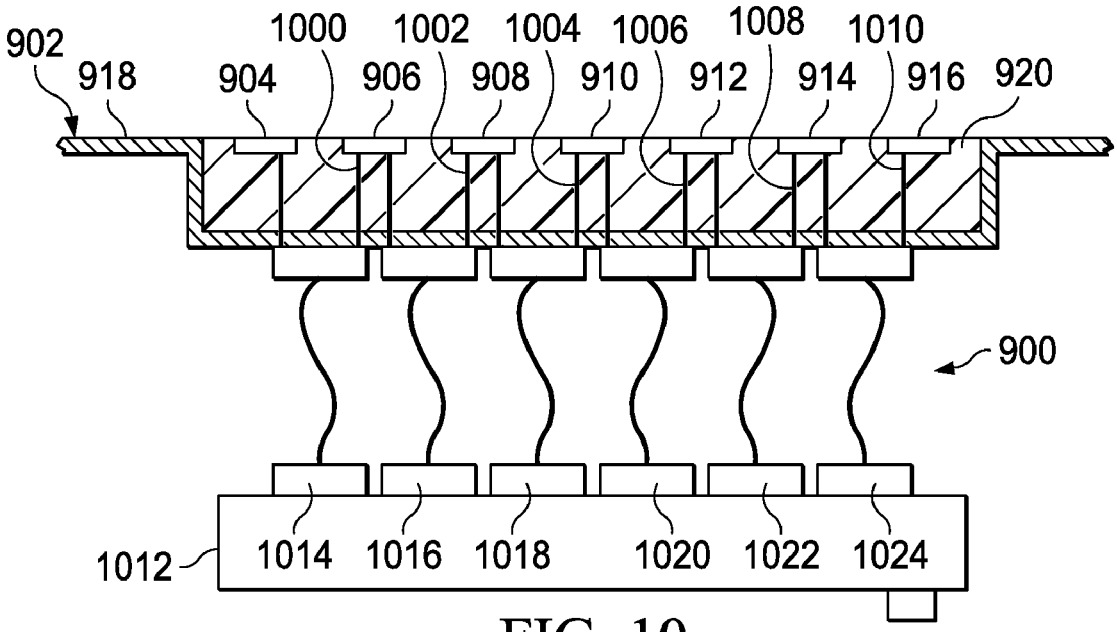
FIG. 10 is a cross-sectional side view of a multi-tap antenna in accordance with an advantageous embodiment.

With reference now to FIG. 10, a cross-sectional side view of a multi-tap antenna is depicted in accordance with an advantageous embodiment. In this example, multi-tap antenna 900 is shown in a cross-sectional side view from the view illustrated in FIG. 9.

As can be seen in this depicted example, transmission lines 1000, 1002, 1004, 1006, 1008, and 1010 in cavity 920 connect to metal patches 904, 906, 908, 910, 912, 914, and 916. As described above, these transmission lines provide the loads for multi-tap antenna 900.

These transmission lines are connected to combiner 1012 through cables 1014, 1016, 1018, 1020, 1022, and 1024. These cables provide the same impedance that is designed for the particular load. For example, if the transmission lines are selected to have a 50 Ohm impedance, the combination of a transmission line with a cable should be selected to have around the same value. In other words, each cable also has a 50 Ohm impedance.

Figure 11:
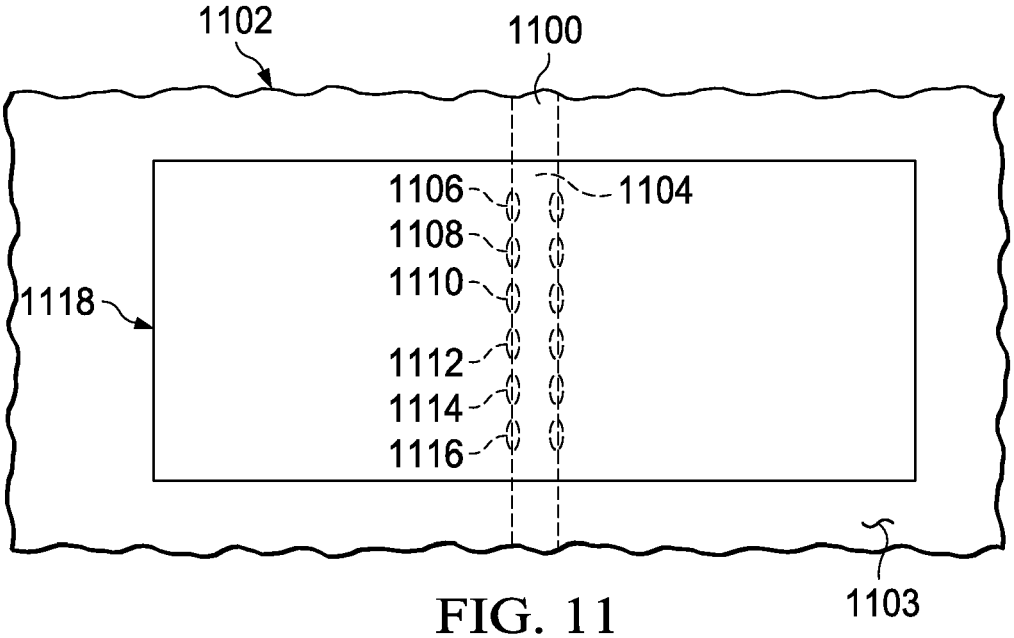
FIG. 11 is a diagram illustrating a multi-tap antenna in accordance with an advantageous embodiment.

With reference now to FIG. 11, a diagram illustrating a multi-tap antenna is depicted in accordance with an advantageous embodiment. Multi-tap antenna 1100 is an example of one implementation for multi-tap antenna 302 in FIG. 3.

In this example, multi-tap antenna 1100 takes the form of a slot antenna and is illustrated as being formed in metallic skin 1102. Multi-tap antenna 1100 is a conformal-type antenna that may conform to surface 1103 of metallic skin 1102.

In particular, slot 1104 is present in surface 1103 of metallic skin 1102. In this example, transmission lines (not shown) bridge slot 1104 at locations 1106, 1108, 1110, 1112, 1114, and 1116. In this example, cavity 1118 is located below surface 1103 of metallic skin 1102.

Figure 12:
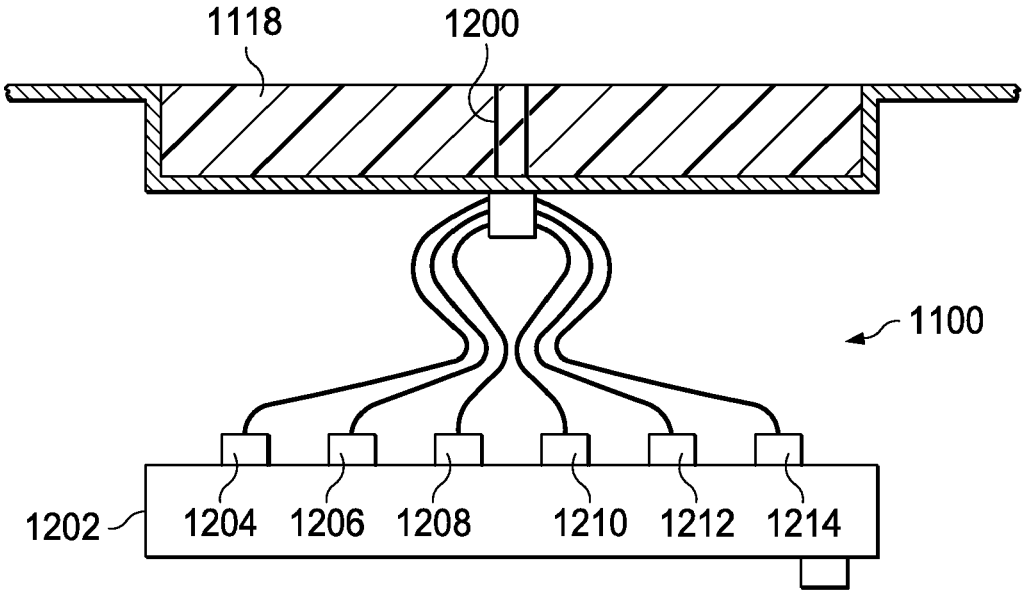
FIG. 12 is a cross-sectional side view of a multi-tap antenna in accordance with an advantageous embodiment.

With reference now to FIG. 12, a cross-sectional side view of a multi-tap antenna is depicted in accordance with an advantageous embodiment. In this example, a cross-sectional side view of multi-tap antenna 1100 is illustrated. Transmission lines 1200 are located within cavity 1118. In this view, only one of transmission lines 1100 is visible in FIG. 12.

In this example, six dual conductor transmission lines may be present within cavity 1118. These transmission lines are connected to combiner 1202 through cables 1204, 1206, 1208, 1210, 1212, and 1214.

Figure 13:
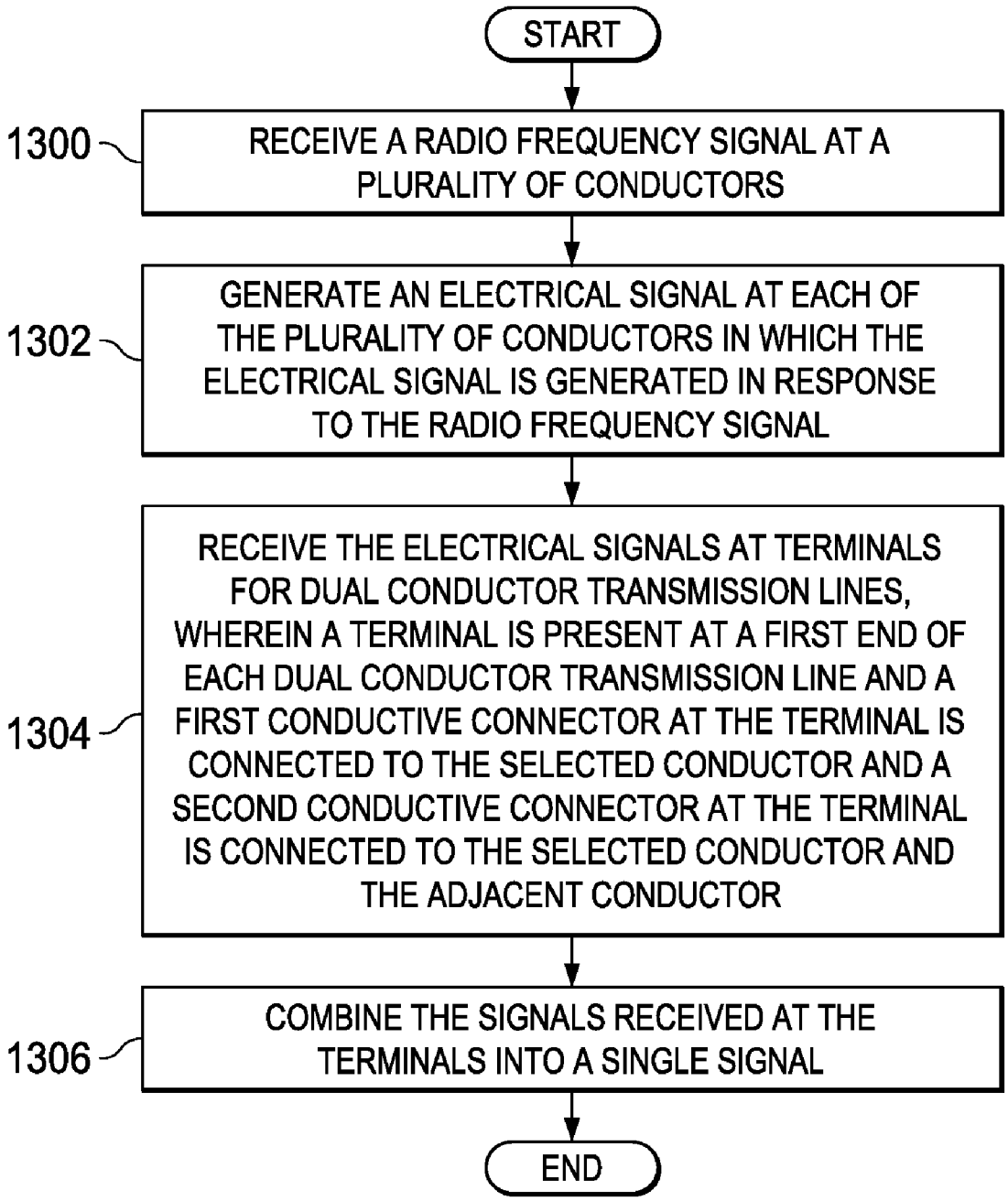
FIG. 13 is a flowchart of a process for receiving radio frequency signal in accordance with an advantageous embodiment.

With reference now to FIG. 13, a flowchart of a process for receiving a radio frequency signal is depicted in accordance with an advantageous embodiment. The process illustrated in FIG. 13 may be implemented in an antenna system, such as antenna system 400 in FIG. 4.

The process begins by receiving a radio frequency signal at a plurality of conductors (operation 1300). The process generates an electrical signal at each of the plurality of conductors in which the electrical signals are generated in response to the radio frequency (operation 1302).

The process receives the electrical signals at terminals for dual conductor transmission lines (operation 1304). In operation 1304, each of the dual conductor transmission lines has a terminal. The terminal has two conductive connectors. A first conductive connector at the terminal is connected to a selected conductor and an adjacent conductor, and a second conductive connector at the terminal is connected to only the selected conductor.

The signals received at the terminals are then combined into a single signal (operation 1306), with the process terminating thereafter. Although the operations in FIG. 13 are illustrated with respect to receiving radio frequency signals, other advantageous embodiments may use the same or similar architecture for a multi-tap antenna to transmit radio frequency signals.

Figure 14:
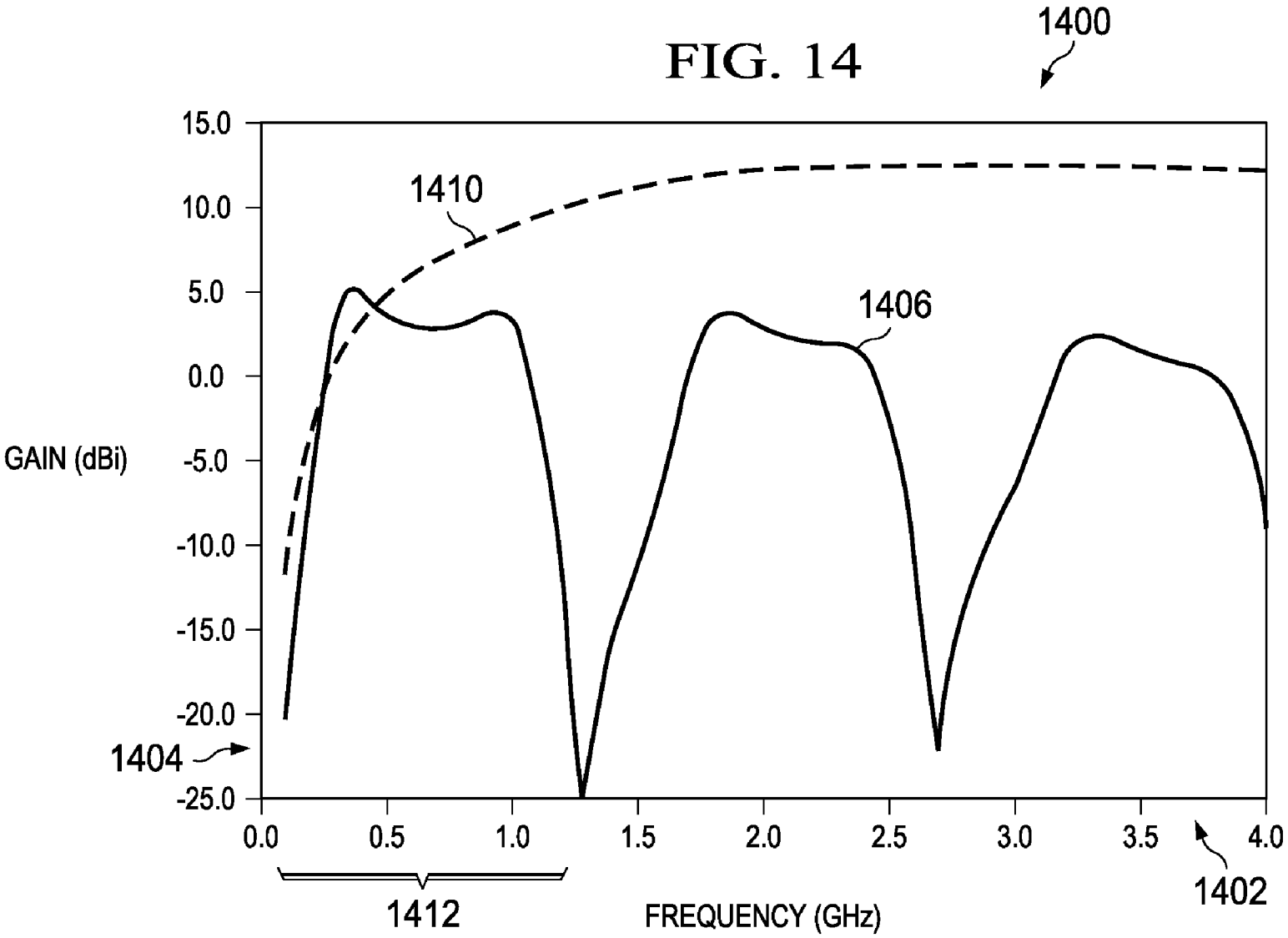
FIG. 14 is a diagram illustrating antenna gain in accordance with an advantageous embodiment.

With reference now to FIG. 14, a diagram illustrating antenna gain is depicted in accordance with an advantageous embodiment. In this example, graph 1400 illustrates frequency on X axis 1402 and gain on Y axis 1404. The data illustrated in this example is for a monopole antenna in the form of a blade antenna.

Line 1406 represents gain that may be realized by a monopole antenna that is currently used. Line 1410 represents gain that may be provided using a multi-tap antenna in accordance with an advantageous embodiment. In these examples, line 1410 may be implemented using a multi-tap antenna such as, for example, multi-tap antenna 700 in FIG. 7.

Only the region indicated by section 1412 is useful for a conventional antenna, because the gain or the radiation patterns are severely degraded elsewhere. In other words, with conventional antennas, a more limited range may be obtained.

As can be seen, using a multi-tap antenna in accordance with an advantageous embodiment provides both broader ranges of frequencies as well as better gain as seen by the gain in line 1410 as compared to a conventional antenna design. Line 1410 shows improvement over a conventional antenna, even at lower frequency ranges.

Thus, the different advantageous embodiments provide a method and apparatus for an antenna. The antenna may include conductors and loads. The loads each have an impedance that is around a desired impedance for an output port for the antenna. In these examples, the conductors may take the form of metal patches or strips. Further, the loads may be dual conductor transmission lines.

With the different advantageous embodiments, multiple structures are provided as conductors as opposed to a single structure with currently available antennas. In addition, the power from the different structures is collected, combined, and sent as a signal through a single port in a manner that provides better performance.

The description of the different advantageous embodiments has been presented for purposes of illustration and description, and is not intended to be exhaustive or limited to the embodiments in the form disclosed. Many modifications and variations will be apparent to those of ordinary skill in the art. Although the different advantageous embodiments have been described with respect to aircraft, other advantageous embodiments may be applied to other types of objects or structures.

For example, without limitation, other advantageous embodiments may be applied to a mobile platform, a stationary platform, a land-based structure, an aquatic-based structure, a space-based structure and/or some other suitable object. More specifically, the different advantageous embodiments may be applied to, for example, without limitation, a submarine, a bus, a personnel carrier, tank, a train, an automobile, a spacecraft, a surface ship, a power plant, a manufacturing facility, and/or a building.

Further, different advantageous embodiments may provide different advantages as compared to other advantageous embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. An antenna system comprising:

a plurality of conductors;

a combiner having an output port; and a plurality of loads connecting the plurality of conductors to each other in line;

wherein the plurality of loads has an impedance equal to around a desired impedance for the output port and wherein the combiner combines power received by the plurality of loads at the output port of the combiner;

wherein the plurality of loads comprises a plurality of transmission lines, wherein a terminal is present at a first end of each transmission line to form a plurality of terminals and wherein each terminal is connected to a selected conductor and an adjacent conductor; and wherein the plurality of transmission lines is a plurality of dual conductor transmission lines, wherein a first conductive connector at the terminal is connected to the selected conductor and the adjacent conductor and a second conductive connector at the terminal is connected to only the selected conductor.

2. An antenna system comprising:

a plurality of conductors capable of receiving radio frequency signals;

a plurality of dual conductor transmission lines, wherein a terminal is present at a first end of each dual conductor transmission line to form a plurality of terminals, and wherein a first conductive connector at the terminal is connected to a selected conductor and a second conductive connector at the terminal is connected to the selected conductor and an adjacent conductor; and a combiner, wherein the combiner has a plurality of inputs connected to a second end of the plurality of dual conductor transmission lines, and wherein the combiner is capable of combining each signal received at the plurality of inputs to form a signal at an output.

3. The antenna system of claim 2, wherein the plurality of conductors is a plurality of transducers capable of transmitting the radio frequency signals.

4. The antenna system of claim 2 further comprising:

a structure, wherein the plurality of conductors, the plurality of dual conductor transmission lines, and the combiner are attached to the structure.

5. The antenna system of claim 4, wherein the structure is selected from one of a mobile platform, a stationary platform, a land-based structure, an aquatic-based structure, a space-based structure, a submarine, a bus, a personnel carrier, a tank, a train, an automobile, a spacecraft, a surface ship, a power plant, a manufacturing facility, and a building.

6. The antenna system of claim 2, wherein the plurality of conductors, the plurality of dual conductor transmission lines, and the combiner are configured to function as an antenna selected from one of a monopole antenna, a blade antenna, a strip antenna, and a slot antenna.

7. The antenna system of claim 2 further comprising:

a collection strip, wherein the plurality of dual conductor transmission lines is located within the collection strip.

8. A method for receiving radio frequency signals at an antenna system, the method comprising:

receiving a radio frequency signal at a plurality of conductors for the antenna system;

generating an electrical signal at each of the plurality of conductors in which the electrical signal is generated in response to the radio frequency signal to form a plurality of electrical signals;

receiving the plurality of electrical signals at a plurality of terminals for a plurality of dual conductor transmission lines, wherein a terminal is present at a first end of each dual conductor transmission line and a first conductive connector at the terminal is connected to a selected conductor and a second conductive connector at the terminal is connected to the selected conductor and an adjacent conductor; and combining the plurality of electrical signals received at the plurality of terminals into a single signal.

9. The method claim 8, wherein a second end at the each dual conductor transmission line is connected to a combiner.

* * * * *